US007992257B2

(12) United States Patent
Kim

(10) Patent No.: US 7,992,257 B2
(45) Date of Patent: Aug. 9, 2011

(54) MOUNTING STRUCTURE OF A DOOR-HANDLE FOR REFRIGERATOR

(75) Inventor: Young Nam Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 337 days.

(21) Appl. No.: 12/167,883

(22) Filed: Jul. 3, 2008

(65) Prior Publication Data

US 2009/0007385 A1 Jan. 8, 2009

(30) Foreign Application Priority Data

Jul. 5, 2007 (KR) ..... 10-2007-0067300

(51) Int. Cl.
*E05B 1/00* (2006.01)

(52) U.S. Cl. ..... 16/412; 16/DIG. 41

(58) Field of Classification Search ..... 16/412, 16/436, 414, 443, 444, DIG. 40, DIG. 41; 292/348, 350, 357–359, 336.3; 49/460, 461; 312/401, 405, 248.6
See application file for complete search history.

(56) References Cited

U.S. PATENT DOCUMENTS

| | | | | |
|---|---|---|---|---|
| 3,017,657 | A * | 1/1962 | Mills | 16/413 |
| 3,152,818 | A * | 10/1964 | Ivins | 403/362 |
| 4,912,809 | A * | 4/1990 | Scheuer | 16/413 |
| 5,144,718 | A * | 9/1992 | Ozawa | 16/412 |
| 5,797,164 | A * | 8/1998 | Donaghy | 16/412 |
| 6,430,780 | B1 * | 8/2002 | Kim et al. | 16/412 |

* cited by examiner

*Primary Examiner* — Chuck Y. Mah
(74) *Attorney, Agent, or Firm* — Birch, Stewart, Kolasch & Birch, LLP

(57) ABSTRACT

The present invention relates to a mounting structure of a door-handle for a refrigerator. By means of the mounting structure of the door-handle for the refrigerator according to preferred embodiments of the present invention, the door-handle is fixedly connected to a door and the fluctuation of the door-handle is decreased while opening the door.

12 Claims, 4 Drawing Sheets

MOUNTING STRUCTURE OF A DOOR-HANDLE FOR REFRIGERATOR

CROSS-REFERENCE TO RELATED APPLICATION

This application claims priority to and the benefit of Korean Patent Application No. 10-10-2007-0067300, filed on 5, Jul. 2007, the entire content of which is incorporated herein by reference.

BACKGROUND OF THE INVENTION

1. Field of the Invention

The present invention relates to a mounting structure of a door-handle for a refrigerator.

2. Description of the Related Art

Refrigerators are household appliances, in which foodstuffs may be stored such that they are refrigerated or frozen depending on the condition or type thereof. For this end, an inner space of the refrigerator is divided into a refrigerating chamber and a freezing chamber.

Further, the inner space which is divided into the freezing chamber and the refrigerating chamber is respectively closed by a freezing chamber door and a refrigerating chamber door, and the freezing chamber door and the refrigerating chamber door are opened/closed by the rotating or sliding operation depending on the type of refrigerator.

Meanwhile, a door-handle is mounted on the freezing chamber door and the refrigerating chamber door in order to make these operations easier for an user.

Particularly, the door-handle is operated as the user exerts force in a direction while holding the door-handle. Here, in case the door-handle is not maintained to be fixedly coupled to the door, the door-handle fluctuates in the direction of external force. Accordingly, since the force pulled by the user to open the door is distributed in many directions, an operation feeling is deteriorated as well as inconvenience of opening the door is suffered.

Also, in case the connection between the door and the door-handle is not solid, the fluctuation occurs in the door-handle when the user operates it, and therefore it is apprehended that the door-handle and the door will be damaged as the number of opening the door is increased and the displacement of the fluctuation is increased.

SUMMARY OF THE INVENTION

The present invention is proposed to solve the above problems and has an object of providing a mounting structure of a door-handle for a refrigerator, which allows the connection relation between a door and the door-handle to be fixedly maintained.

Furthermore, another object of the present invention is to provide a mounting structure of a door-handle for a refrigerator, which prevents a connection site between doors from being damaged or prevents a door-handle from detaching from a door by maintaining the connection relation between the door and the door-handle to be robust.

To achieve the objects of the present invention, as embodied and broadly described herein, there is provided a mounting structure of a door-handle for a refrigerator, including: a door for selectively opening/closing a refrigerating chamber or a freezing chamber; a door-handle attached on a front surface of the door; a handle fixture, of which one end is inserted into the door and the other end is inserted into the door-handle; a support bracket provided in the door-handle, in which one end of the handle fixture is inserted; and a fixing element for maintaining the connection of one end of the handle fixture to the support bracket.

BRIEF DESCRIPTION OF THE DRAWINGS

The above and other objects, features and advantages of the present invention will be more apparent from the following detailed description taken in conjunction with the accompanying drawings, in which:

FIG. 4 is an exploded perspective view showing an aspect that the handle fixture is connected to a freezing chamber door-handle.

DETAILED DESCRIPTION OF THE PREFERRED EMBODIMENTS

Hereinafter, a mounting structure of a door-handle for a refrigerator according to the present invention will be described in detail with reference to the accompanying drawings.

Before disclosing the detailed explanation of the present invention, it should be understood that the mounting structure of the door-handle for the refrigerator of the present invention can be applied to various types of refrigerators such as a double-door type refrigerator, a bottom freezer type refrigerator and a three-door type refrigerator, although directivity may be changed depending on the type of refrigerator. Hereinafter, the three-door type refrigerator will be explained for the convenience of explanation.

Figure 1:
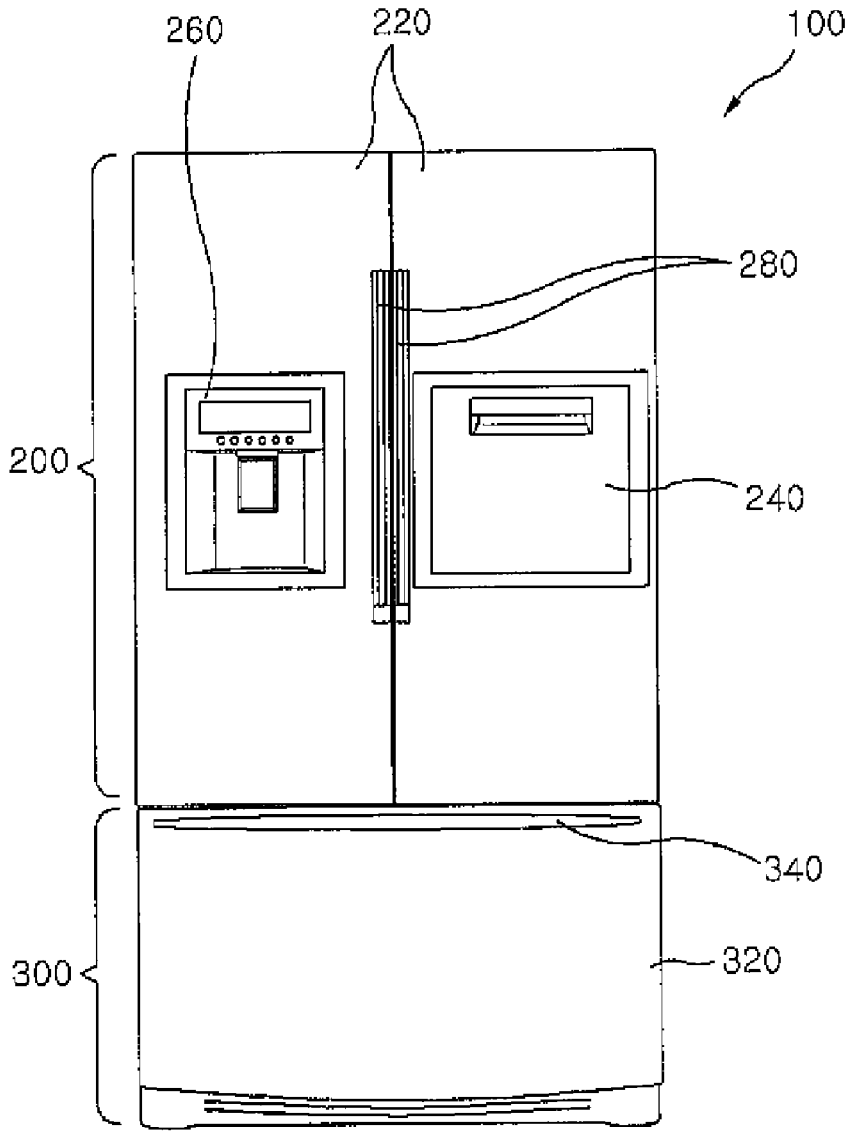
FIG. 1 is a front view of a refrigerator with a mounting structure of a door-handle for the refrigerator according to a preferred embodiment of the present invention.
Figure 2:
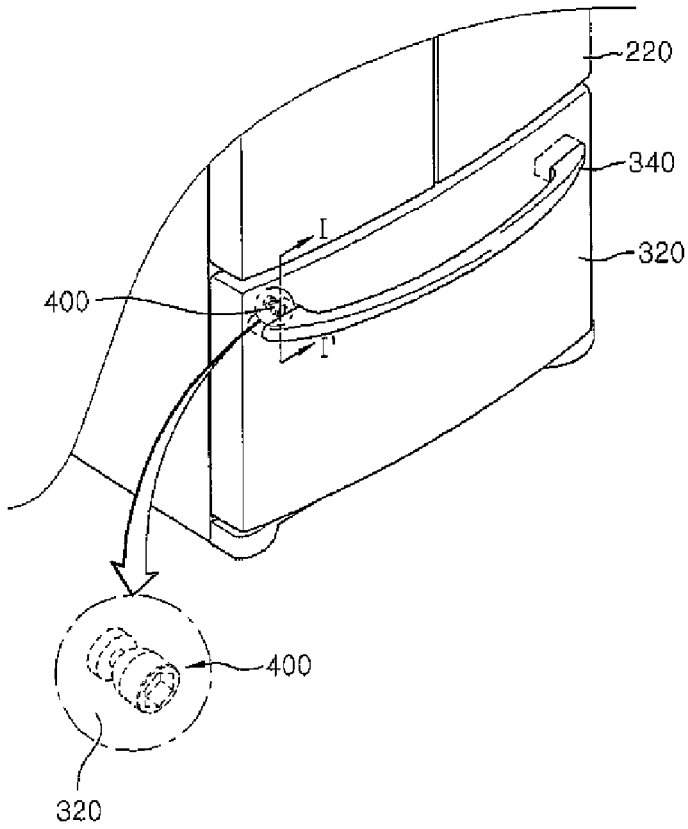
FIG. 2 is an exploded perspective view showing a mounting structure of a door-handle for a refrigerator according to a preferred embodiment of the present invention.

FIG. 1 shows a refrigerator with a mounting structure of a door-handle for the refrigerator according to a preferred embodiment of the present invention in a front view, and FIG. 2 shows a mounting structure of a door-handle for a refrigerator according to a preferred embodiment of the present invention in an exploded perspective view.

Referring to FIGS. 1 and 2, a refrigerator 100 according to the present invention may be a three-door type refrigerator, in which a refrigerating chamber 200 is provided at an upper part in a main body and a freezing chamber 300 is provided at a lower part in the main body. In detail, the refrigerator 100 includes a pair of refrigerating chamber doors 220 for opening/closing the refrigerating chamber 200, and a freezing chamber door 320 for opening/closing the freezing chamber 300. The refrigerating chamber doors 220 are pivotably provided at both side ends of the refrigerator main body, respectively, and the freezing chamber door 320 is movably provided at the refrigerator main in a sliding manner to and fro. More Specifically, a basket for storing foods is provided at a rear surface of the freezing chamber door 320. And, the basket is pushed or drawn in/from the freezing chamber 300 as the freezing chamber door 320 moves in a back-and-forth direction.

Further, the refrigerating chamber doors 220 may further include a home-bar 240 which allows foods or beverages to be drawn or stored from the outside in a simple way, and a dispenser from which ice or water is dispensed.

In addition, a refrigerating chamber door-handle 280 is longitudinally provided at the refrigerating chamber doors 220, so that the user may easily operate the rotational movement of the refrigerating chamber doors 220. And, a freezing chamber door-handle 340 is laterally provided at the freezing chamber door 320, thereby making the movement to and fro of the freezing chamber door 320 easy.

Meanwhile, the freezing chamber door-handle 340 is fixed to a front surface of the refrigerating chamber door 220 by a handle fixture 400. One end of the handle fixture 400 is inserted into a front surface of the refrigerating chamber door 220, and the other end is inserted into an end of the freezing chamber door-handle 340.

Hereinafter, the structure of the handle fixture 400, and the connection relation between the handle fixture 400 and the freezing chamber door-handle 340 will be explained in detail with reference to the drawings.

Figure 3:
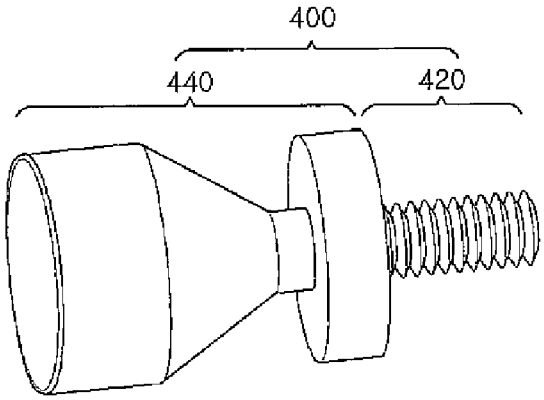
FIG. 3 is a perspective view of a handle fixture according to a preferred embodiment of the present invention.
Figure 5:
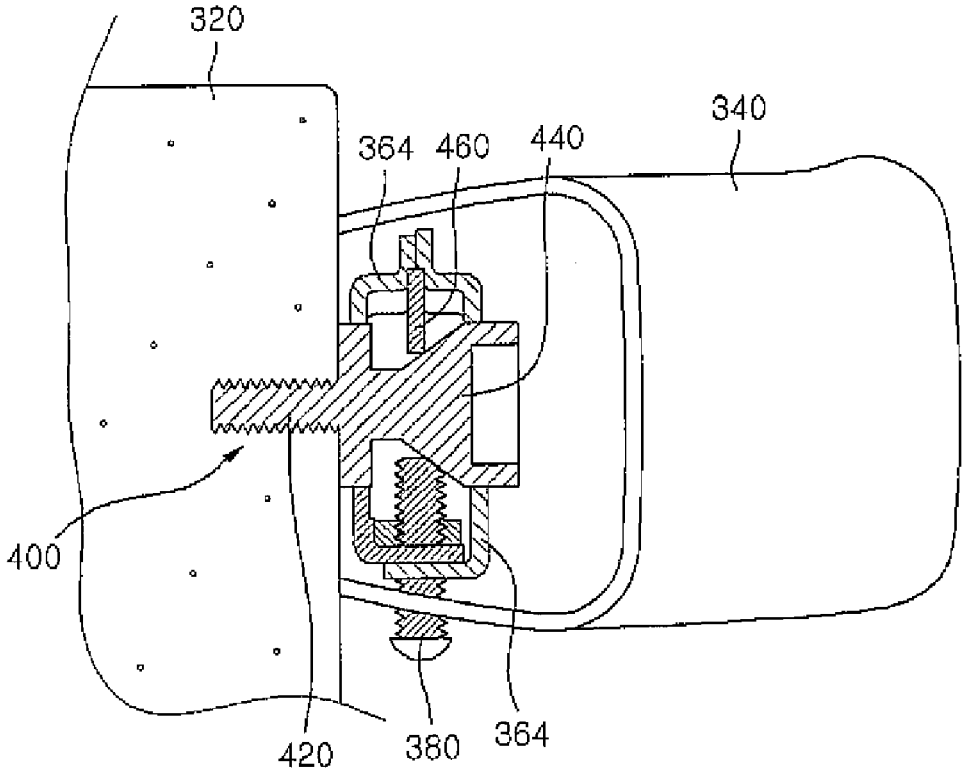
FIG. 5 is a cross-sectional view taken along line I-I' in FIG. 2.

FIG. 3 shows a handle fixture according to a preferred embodiment of the present invention in a perspective view, FIG. 4 shows an aspect that the handle fixture is connected to the freezing chamber door-handle in an exploded perspective view, and FIG. 5 shows a cross-section taken along line I-I' in FIG. 2.

Referring to FIGS. 3 to 5, a screw thread is formed on an outer circumferential surface of the handle fixture 400, and it is inserted into a fastener hole, not illustrated, provided at the freezing chamber door 320.

In detail, the handle fixture 400 is composed of a door-side fastening part 420 which is inserted into the freezing chamber door 320 as it rotates in one direction, and a handle-side insertion part 440 which is formed integrally with the door-side fastening part 420 and is accommodated in the freezing chamber door-handle 340.

Also, a structure which allows the handle fixture 400 to be inserted and fixed therein is respectively formed at both sides of the freezing chamber door-handle 340.

In detail, a bracket assembly 360 in which the handle-side insertion part 440 is accommodated is provided at an end of the freezing chamber door-handle 340. And, the bracket assembly 360 is composed of a double-layered support bracket 364 in which a specific space is formed as 2 layers layers overlap each other. And, tops of the support bracket 364 of 2 pieces may be connected to each other and, at the same time, be attached to an inner circumferential surface of the freezing chamber door-handle 340 by a welding. Here, the support bracket 364 may be configured that both ends thereof are connected to each other as one plate-shaped piece is bent at a time, and it may also be configured in another way. And, a fixture inserting hole 362 is formed at an approximate center of the double-layered support bracket 364. And, the handle-side insertion part 440 of the handle fixture 400 is inserted through the fixture inserting hole 362.

Also, a perforated hole of a predetermined size is formed at a bottom surface of the freezing chamber door-handle 340, and a perforated hole having the same diameter is also formed at a bottom surface of the support bracket 364. And, a fixing element 380 is perforated and inserted into the perforated hole and it presses an outer circumferential surface of the handle-side insertion part 440. An element such as a screw may be used as the fixing element 380.

In addition an anti-wobbling means, which supports the handle-side insertion part 440 in a direction opposite to the pressing direction of the fixing element 380, is provided at a top of the support bracket 364.

In detail, the anti-wobbling means may be integrally connected with the double-layered support bracket 364, as it is fitted into a gap in a region where 2 pieces of the support bracket 364 are contacted with each other. Of course, in case of the structure where one plate-shaped piece is bent at one time, the anti-wobbling means may be fitted into a region where both ends are contacted with each other. And, the anti-wobbling means may be a support projection 460 having the same shape as the fixing element 380. Of course, a vertical line crossing the center of the support projection 460 and a vertical line crossing the center of the fixing element 380 are preferably disposed on the same line. Therefore, the fixing element 380 is inserted into the freezing chamber door-handle 340 as it rotates, thereby pressing the handle-side insertion part 440. Therefore, a phenomenon, that the handle-side insertion part 440 is separated from the support bracket 364 or is shaken, may be prohibited, as the support projection 460 also presses the handle-side insertion part 440.

Also, the handle-side insertion part 440 may be formed to be inclined as shown in the drawings, and particularly, the handle-side insertion part may be formed to be inclined in such a manner that it is widen while being spaced apart from the freezing chamber door 320. By means of this structure, when the user pulls the freezing chamber door-handle 340 to open the freezing chamber door 320, external force is exerted to a surface of the handle-side insertion part 440 by the support projection 460 and the fixing element 380. Therefore, a phenomenon that the handle-side insertion part 440 is separated from the support bracket 364 may be prevented.

Figure 6:
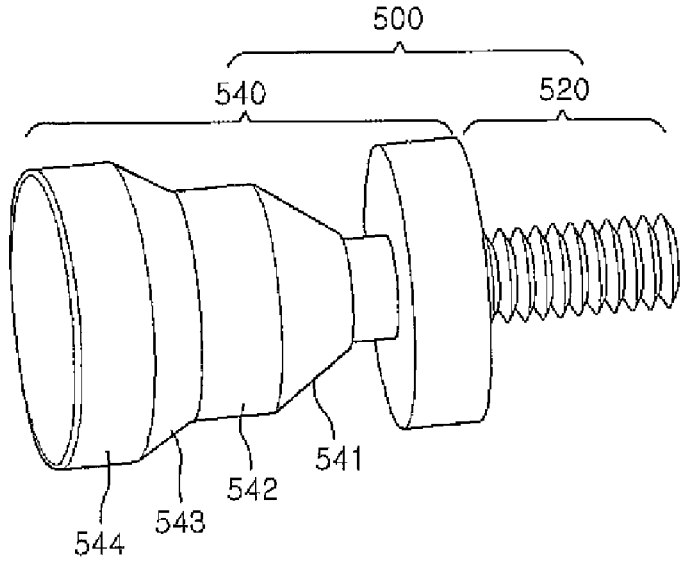
FIG. 6 is a perspective view of a handle fixture according to another preferred embodiment of the present invention.
Figure 7:
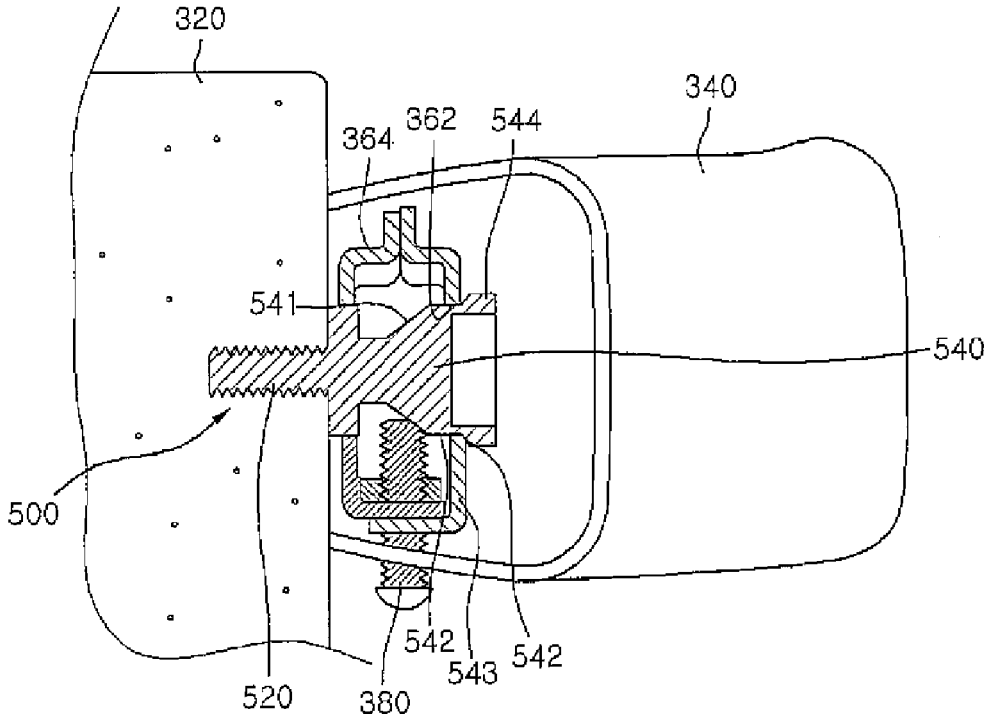
FIG. 7 is a cross-sectional view taken along line I-I' in FIG. 2, where a handle fixture according to another preferred embodiment of the present invention is provided.

FIG. 6 shows a handle fixture according to another preferred embodiment of the present invention in a perspective view, and FIG. 7 shows a cross-section taken along line I-I' in FIG. 2, where a handle fixture according to another preferred embodiment of the present invention is provided.

Referring to FIGS. 6 and 7, the mounting structure of a door-handle according to another preferred embodiment of the present invention is configured that a peripheral portion of the fixture inserting hole 362 formed in the support bracket 364 is fastened with a handle fixture 500.

In detail, according to this embodiment, an anti-wobbling means such as a support projection 460 is not required. However, it is also possible to provide the support projection 460.

More specifically, the handle fixture 500 according to this embodiment is composed of a door-side fastening part 520 and a handle-side insertion part 540 in the same way of the previous embodiment. However, there is a difference in that a first slanted surface 541 and a second slanted surface 543 are formed at the handle-side insertion part 540. And, the first and second slanted surfaces 541, 543 are inclined in such a manner that they are widen while being spaced apart from the freezing chamber door 320.

Meanwhile, an end of the fixing element 380 is contacted to the first slanted surface 541 in the same way of the previous embodiment. And, an inner peripheral portion of the fixture inserting hole 362 is contacted to the second slanted surface 543.

Also, a support surface 542 having the same diameter is formed between the first slanted surface 541 and the second slanted surface 543, and a fastening end 544 is formed at a rear end of the second slanted surface 543. And, the diameter of the fastening end 544 is greater than the diameter of the support surface 542, and this is apparent in the light of the inclined orientation of the first and second slanted surfaces 541, 543.

According to this structure, when the user pulls the freezing chamber door-handle 340, the handle-side insertion part 540 is initially prevented from being separated from the support bracket 364 by the fixing element 380. And, the handle-side insertion part 540 is further prevented from being separated from the support bracket 364 by the contact of the fixture inserting hole 362 with the second slanted surface 543. Of course, in case a structure such as the support projection 460 is provided at an opposite side of the fixing element 380, the handle fixture 500 may be further stably supported further stable.

It is to be pointed out that the mounting structure of a door-handle for a refrigerator according to the present invention is not restricted to the above-described embodiments, but on the contrary it has to be understood that many modifications, additions, variations or substitutions may be resorted to the present invention, without altering its spirit or departing from its scope of protection, as it is defined in the appended claims. And, it is intended that the present invention covers such modifications and variations as come within the scope of the appended claims and their equivalents.

What is claimed is:

1. A mounting structure of a door-handle for a refrigerator, comprising:

a door for selectively opening/closing a refrigerating chamber or a freezing chamber;

a door-handle attached on a front surface of the door;

a handle fixture, of which one end is inserted into the door and the other end is inserted into the door-handle;

a support bracket provided in the door-handle, in which one end of the handle fixture is inserted;

a fixing element for maintaining the connection of one end of the handle fixture to the support bracket; and an inserting hole formed at the support bracket for connection to an end of the handle fixture, wherein a peripheral portion of the inserting hole contacts an outer circumferential surface of the handle fixture, the outer circumferential surface formed to be inclined.

2. The mounting structure according to claim 1, wherein the handle fixture is configured with a door-side fastening part which is inserted into a front surface of the door, and a handle-side insertion part which is inserted into the door-handle, and wherein the fixing element presses an outer circumferential surface of the handle-side insertion part.

3. The mounting structure according to claim 2, further comprising:

an anti-wobbling means which is provided at an opposite side to the fixing element, wherein one end of the anti-wobbling means is contacted with an outer circumferential surface of the handle-side insertion part.

4. The mounting structure according to claim 3, wherein an other end of the anti-wobbling means is fixed to the support bracket.

5. The mounting structure according to claim 3, wherein the anti-wobbling means is formed inside of the support bracket and protruded toward the handle fixture.

6. The mounting structure according to claim 1, wherein the fixing element comprises a screw.

7. A mounting structure of a door-handle for a refrigerator, comprising:

a door for selectively opening/closing a refrigerating chamber or a freezing chamber;

a door-handle attached on a front surface of the door;

a handle fixture, of which one end is inserted into the door and the other end is inserted into the door-handle;

a support bracket provided in the door-handle, in which one end of the handle fixture is inserted;

a fixing element for maintaining the connection of one end of the handle fixture to the support bracket; and an inserting hole formed at the support bracket for connection to an end of the handle fixture, wherein a peripheral portion of the inserting hole contacts an outer circumferential surface of the handle fixture, and wherein the outer circumferential surface of the handle fixture has a diameter which increases toward an end thereof.

8. The mounting structure according to claim 7, wherein the handle fixture is configured with a door-side fastening part which is inserted into a front surface of the door, and a handle-side insertion part which is inserted into the door-handle, and wherein the fixing element presses an outer circumferential surface of the handle-side insertion part.

9. The mounting structure according to claim 8, further comprising:

an anti-wobbling means which is provided at an opposite side to the fixing element, wherein one end of the anti-wobbling means is contacted with an outer circumferential surface of the handle-side insertion part.

10. The mounting structure according to claim 9, wherein an other end of the anti-wobbling means is fixed to the support bracket.

11. The mounting structure according to claim 9, wherein the anti-wobbling means is formed inside of the support bracket and protruded toward the handle fixture.

12. The mounting structure according to claim 7, wherein the fixing element comprises a screw.

* * * * *